US006566793B2

(12) United States Patent
Honda et al.

(10) Patent No.: US 6,566,793 B2
(45) Date of Patent: May 20, 2003

(54) SPARK PLUG

(75) Inventors: Toshitaka Honda, Iwakura (JP); Makoto Sugimoto, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 81 days.

(21) Appl. No.: 09/725,083

(22) Filed: Nov. 29, 2000

(65) Prior Publication Data

US 2001/0002096 A1 May 31, 2001

(30) Foreign Application Priority Data

Nov. 30, 1999 (JP) ..... 11-341233

(51) Int. Cl.[7] ..... H01T 13/20
(52) U.S. Cl. ..... 313/141; 313/140; 123/169
(58) Field of Search ..... 313/140–141, 313/143, 118, 135; 123/169, 169 R

(56) References Cited

U.S. PATENT DOCUMENTS 4,427,915 A * 1/1984 Nishio et al. ..... 313/131 A
5,760,534 A * 6/1998 Bednar et al. ..... 313/123
6,310,430 B1 * 10/2001 Moriya ..... 123/169 EL

FOREIGN PATENT DOCUMENTS

EP 0 954 074 A2 11/1999
JP 02033879 A * 2/1990 ..... H01T/13/20
JP 11-273827 10/1999

* cited by examiner

*Primary Examiner*—Ashok Patel
*Assistant Examiner*—Anthony T. Perry
(74) *Attorney, Agent, or Firm*—Morgan, Lewis & Bockius LLP

(57) ABSTRACT

In a spark plug of the invention, as the top end edge of a terminal 13 is located within a middle trunk portion 2*g* of the insulator 2 with a longer reach of the screw portion 7, it acts as a support against fracture, more likely causing the problem of strength. Thus, the wall thickness of the middle trunk portion 2*g* at a position corresponding to the top end edge of the terminal 13 is sufficiently secured to be 0.42 or larger, based on the value of (D–d)/D, whereby it is possible to prevent the inconvenience such as fracture of the insulator, particularly, the middle trunk portion 2*g* from occurring owing to some strong force of bending, impact or torque applied on the insulator 2, when the spark plug is attached.

8 Claims, 5 Drawing Sheets

SPARK PLUG

BACKGROUND OF THE INVENTION

1. Field of the Invention

The present invention relates to a spark plug for use in an internal combustion engine such as an automobile engine.

2. Description of the Related Art

A spark plug for the purpose of igniting, for example, a gasoline engine for automobile, is attached on a cylinder head of the engine by means of a screw portion formed in a metal shell. A spark discharge gap formed by a ground electrode and a center electrode is located within a combustion chamber in this attached state to ignite a fuel-air mixture. Here, an electrode portion for forming the spark discharge gap is subjected to a combustion mixture gas during engine operation, and heated to considerably high temperature. Recently, a suction valve and an exhaust valve in the combustion chamber occupy larger areas along with the increasingly higher output of the internal combustion engine for use with the automobile. Therefore, it is required to reduce the size of the spark plug for use to ignite the mixture gas, and the temperature inside the combustion chamber tends to rise more highly owing to the operation of a supercharger such as a turbo charger.

In order to maintain a full life of the spark plug under the severe service conditions, it is required that the heat radiation (heat release) of the electrode portion is effected to sufficient extent. The heat of the spark plug is radiated via various passages, but in particular in a passage leading from an insulator through the screw portion of the metal shell to a cylinder head, a large quantity of heat flow will escape, and this passage plays an important role for effecting the heat radiation. In a commonly used spark plug, the length (reach) of this screw portion has a maximum value of at most about 19 to 20 mm, but lately an attempt of improving the heat radiation performance of the spark plug has been made by further lengthening this thread reach.

By the way, as the screw portion is made a long reach, the insulator made of ceramic such as alumina is obliged to be longer. In this case, there is the problem that if any impact or excessive torque is exerted in attaching the spark plug, the insulator is likely to fracture or crack. For example, in a case of a spark plug having a resistor incorporated into the insulator, the resistor is disposed through a through hole of the insulator between the terminal and the center electrode, but when a bending force is applied to the insulator, the top end edge of the terminal located within the through hole is liable to act as a support against fracture, resulting in the problem that the insulator is more likely to break.

SUMMARY OF THE INVENTION

It is an object of the present invention to provide a spark plug which is able to maintain the breaking strength of the insulator even if the screw portion is lengthened, and is structured less likely to cause inconvenience such as breakage of the insulator, when the spark plug is attached.

In order to solve the above-described problems, a spark plug according to the present invention comprises an axial center electrode, an axial insulator covering the outside of the center electrode, a metal shell shaped like a barrel that is open at both ends and disposed outside the center electrode, and a ground electrode for forming a spark discharge gap with respect to the center electrode, the ground electrode connected to the metal shell, characterized in that the forward side of the insulator is defined as the side where the spark discharge gap is located in an axial direction of the insulator, the backward side being defined as the opposite side, a screw portion portion has a thread reach of 25 mm or greater on an outside circumferential surface located at the forward end portion of the metal shell, and a portion of the insulator located within the metal shell half way in the axial direction has a peripheral flange portion protruding outward and a middle trunk portion adjacent the forward side of the flange portion, wherein a through hole is formed in the axial direction of the insulator, a terminal is secured at the rear end side of the insulator, the center electrode is secured at the front end side of the insulator, and an electrically conductive binder layer is disposed between the terminal and the center electrode within the through hole, the terminal having the top end edge located with getting into the middle trunk portion of the insulator, and wherein the wall thickness of the middle trunk portion is determined to satisfy the relation such as, $$0.42 \leqq (D-d)/D \leqq 0.79$$

where the outer diameter of the middle trunk portion at a position corresponding to the top end edge of the terminal is D, and the inner diameter of the through hole in the middle trunk portion is d.

In a typical spark plug, an insulator 201 has a flange-like large flange portion (referred to as a flange portion) 201*a* formed to be caulked to a metal shell 200, and a middle trunk portion 201*b* closer to the top end of the insulator 201, as shown in FIG. 4A. In the spark plug having a thread reach of 20 mm or less, a terminal 202 is adjusted in length to have its top end edge within the flange portion 201*b*. On the other hand, with a larger thread reach, there is the need of lengthening the middle trunk portion 201*b* of the insulator 201. However, since the length of a resistor or an electrically conductive binder layer 203 such an electrically conductive glass seal layer can not be extended freely owing to the restrictions from its electrical characteristics or production conditions, a way of extending the top end portion of the terminal 202*b* is employed.

As a result, in the case where it is necessary to have a structure in which the top end portion of the terminal 202*b* extends into the middle trunk portion 201*b*, the top end edge of the terminal 202, which is located within the middle trunk portion 201*b* that is thinner than the flange portion 201*a*, acts as a support against fracture, when a bending force is exerted externally, and there is more likelihood of causing the crack C, as shown in FIG. 4B. In particular, in a spark plug of long reach type having a thread reach of 25 mm or greater according to the present invention, the length of the middle trunk portion 201*b* is necessarily longer, so that a larger bending moment is caused by application of an outside force and exerted on a support against fracture, resulting in the severe problem such a breakage. Thus, in the present invention, the wall thickness of the middle trunk portion at a position corresponding to the top end edge of the terminal is sufficiently set to be 0.42 or larger, based on the previous value of (D−d)/D, whereby the endurance strength against the bending of insulator or impact thereon is remarkably improved, and further, it is possible to prevent the inconvenience such as fracture of the insulator when the spark plug is attached. However, if the value of (D−d)/D is beyond 0.79, the inner diameter d of the through hole is too small to secure the thickness of center electrode fully, leading to malfunction of the spark plug to cause degraded heat releasing characteristic. Note that the value of (D−d)/D is preferably set in the range from 0.43 to 0.60.

FIGS. 4A and 4B is a typical view illustrating a common structure of the spark plug, but not representing the public nature of the constitutional elements of the present invention.

DETAILED DESCRIPTION OF THE PREFERED EMBODIMENT

The preferred embodiments of the present invention will be described below by way of example with reference to the drawings.

Figure 1A:
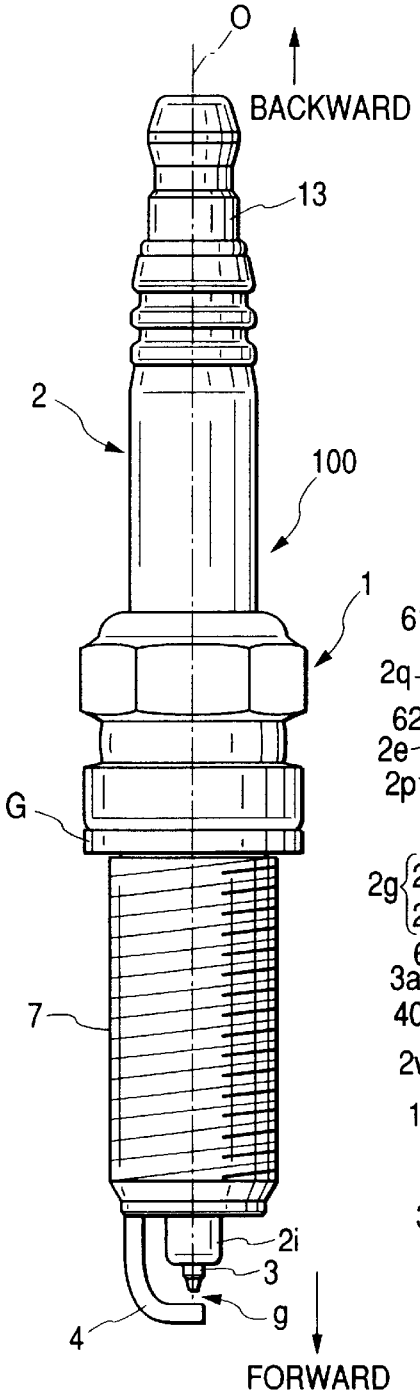
FIGS. 1A to 1C are front views and the longitudinal cross-sectional views of a spark plug according to one embodiment of the present invention.
Figure 1B:
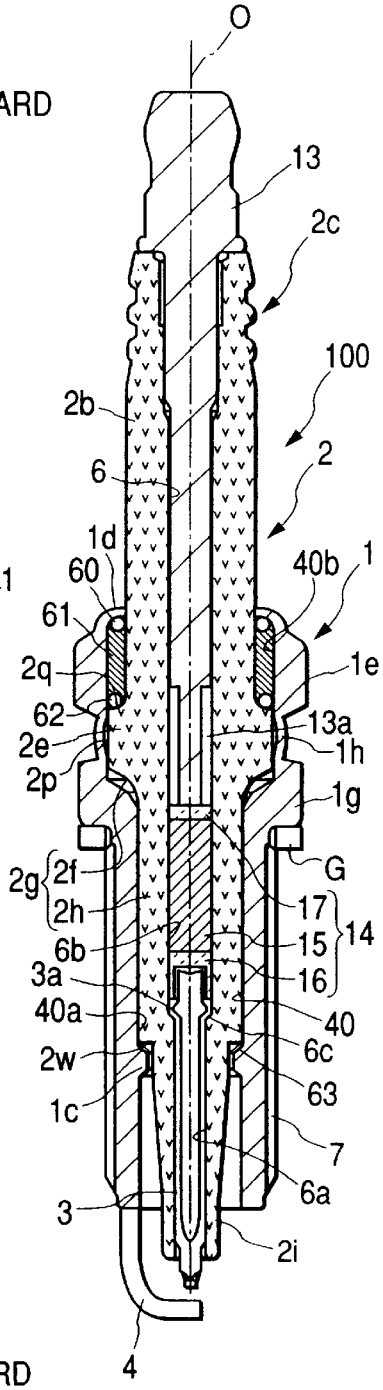
Figure 1C:
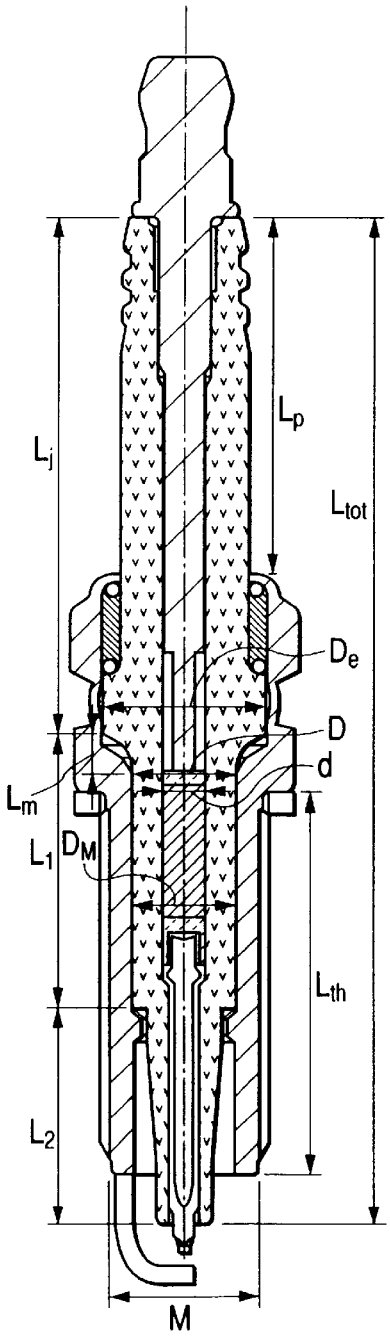

FIGS. 1A to 1C illustrate one embodiment of a spark plug according to the invention. Particularly, FIG. 1A is a front view of the appearance of the spark plug, and FIG. 1B is a longitudinal cross-sectional view of the spark plug. Further, FIG. 1C shows the dimensional relation of the parts in the longitudinal cross-sectional view of FIG. 1B. A spark plug 100 comprises a barrel-like metal shell 1, an insulator 2 inlaid into the metal shell 1 so that a top end portion 2*i* of the insulator 2 projects thereto, a center electrode 3 disposed inside the insulator 2, and a ground electrode 4 having one end joined to the metal shell 1 by welding or the like. A spark discharge gap g is formed between the ground electrode 4 and the center electrode 3. Herein, the "forward" side of the spark plug is defined as the side where the spark discharge gap g is formed in a direction of the axial line O of the insulator 2, and the "backward" side is defined as the opposite side.

The insulator 2 is formed with a through hole 6 penetrating through the insulator 2 axially at the central position in cross section taken along the axial direction. A terminal 13 is provided at the rear end portion of the insulator 2, and the center electrode 3 is secured at the front end portion thereof. Within the through hole 6, a resistor 15 is disposed between the terminal 13 and the center electrode 3. Both ends of this resistor 15 are electrically connected to the center electrode 3 and the terminal 13 via electrically conductive glass seal layers 16, 17. The electrically conductive glass seal layers 16, 17 and the resistor 15 make up an electrically conductive binder layer 14. On an outer circumferential surface at the top end of the terminal 13, an engaging portion 13*a* like a male screw (or a knurling tool) is formed, and embedded into an electrically conductive glass seal layer 17 to reinforce the binding force.

The resistor 15 is made of resistor composition that is obtained by sintering with the hot press a mixture of glass powder and conductive material powder (or ceramic powder other than glass as required). Note that one electrically conductive glass seal layer may be used to have the terminal 13 and the center electrode 3 integrally by omitting the resistor 15. In this case, the electrically conductive glass seal layer constitutes the electrically conductive binder layer.

The insulator 2 is made of an insulating material such as alumina as a whole. Half way of the insulator 2 in the axial direction, a peripheral flange portion 2*e* protruding outward is formed like a flange. And the insulator 2 has a backward main portion 2*b* that is formed in thinner diameter on the backward side of the flange portion 2*e*. An outer circumferential surface of the backward main portion 2*b* has a corrugation 2*c*. On one hand, a middle trunk portion 2*g* that is thinner in diameter than the flange portion 2*e*, and a top end portion 2*i* that is further thinner in diameter than the middle trunk portion 2*g* are formed in this order on the forward side of the flange portion 2*e*. The top end portion 2*i* is connected to the middle trunk portion 2*g* via a peripheral stage portion 2*w* (that belongs to the top end portion 2*i*), the outer circumferential surface being conical with the diameter smaller toward the top end.

In this specification, the forward edge position of the flange portion 2*e* is defined as the forward marginal position in the axial direction where the flange portion 2*e* has the largest outer diameter, and a further forward portion of the insulator 2 is treated as belonging to the middle trunk portion 2*g*. In this embodiment, a section where the flange portion 2*e* has the largest outer diameter forms an outer circumferential surface 2*p* like a substantially cylindrical face, and a section up to the forward end edge of the outer circumferential surface 2*p* in the direction of the axial line O belongs to the flange portion 2*e*. On the other hand, the boundary between the backward main portion 2*b* and the flange portion 2*e* is defined as the forward margin of a stage-like connecting portion 2*q* connecting both the backward main portion 2*b* and the flange portion 2*e*. Accordingly, the connecting portion 2*q* is treated as belonging to the backward main portion 2*b*.

The middle trunk portion 2*g* is formed at a connecting position with the flange portion 2*e* in the axial direction, having a connecting section 2*f* where the axial sectional size changes continuously or stepwise to have the largest diameter at the side of the flange portion 2*e* and a middle trunk main section 2*h* having a substantially uniform axial sectional size following the connecting section 2*f*. In this embodiment, the outer circumferential surface of the middle trunk main section 2*h* is made substantially cylindrical. Also, the connecting section 2*f* is tapered or made concave.

The metal shell 1 is formed like a cylinder using a material such as an iron-based material suitable for the cold working, e.g., low carbon steal or carbon steel wire for cold forging as defined in JISG 3539, and constitutes a housing of the spark plug 100. On the outer circumferential surface at the front end side, a screw portion 7 for attaching the spark plug 100 to an engine block, not shown, is formed. A ring gasket G is fitted into a base portion of the screw portion 7. Also, a flange-like gas seal portion 1*g* extending outward is formed peripherally around the outer circumferential surface of the metal shell 1 on the backward side of the screw portion 7. And on the further backward side thereof, a tool engaging portion 1*e* for engaging a tool such as a spanner or wrench is outwardly protruded peripherally around the outer circumferential surface of the metal shell 1, to screw the spark plug 100 into a tapping hole of the cylinder head side via a thin connecting portion 1*h*. The tool engaging portion 1*e* has an axial sectional shape of substantially regular hexagon, also referred to as a hexagonal portion. The spark plug 100 is attached to a cylinder head not shown by the screw portion 7, and used as an ignition source to ignite the fuel-air mixture that is supplied to the combustion chamber. In this case, the gasket G is compressed, crushed and deformed between the gas seal portion 1*g* and the peripheral marginal portion around the opening of tapping hole, playing a role of sealing a gap between the tapping hole and the screw portion 7.

The metal shell 1 is formed with an internal bore 40 for insertion of the insulator 2 in the axial direction. On an inner peripheral surface of a part of the internal bore 40 corresponding to the screw portion 7, a peripheral convex portion 1*c* (or an engaging portion on the metal shell side) is formed at an intermediate position thereof slightly closer to the forward side. And a middle bore portion 40*a* for receiving the middle trunk portion 2*g* of the insulator 2 is located backward of the convex portion 1*c*, and a large bore portion 40*b* for receiving the flange portion 2*e* is made on the further backward side by having the larger diameter.

The axial sectional diameter of the center electrode 3 is set smaller than that of the resistor 15. And a through hole 6 of the insulator 2 has a first portion 6*a* of substantially cylindrical shape for inserting the center electrode 3 therethrough and a second portion 6*b* of substantially cylindrical shape that is made in larger diameter backward (or upward in the figure) of the first portion 6*a*. The terminal 13 and the resistor 15 are received within the second portion 6*b*, and the center electrode 3 is inserted through the first portion 6*a*. An electrode fixing convex portion 3*a* is formed to extend outward from the outer peripheral surface on the rear end portion of the center electrode 3. And the first portion 6*a* and the second portion 6*b* of the through hole 6 are communicated to each other within the middle trunk portion 2*g*, and a convex receiving face 6*c* for receiving the electrode fixing convex portion 3*a* is formed as a taper face or R face at the connecting position between the first portion 6*a* and the second portion 6*b*.

The tool engaging portion 1*e* of the metal shell 1 is located backward of the flange portion 2*e* of the insulator 2. The insulator 2 is inserted into the metal shell 1 through a backward side opening, and a stage portion 2*w* as the insulator engaging portion is engaged with the convex portion 1*c* (or engaging portion on the metal shell side) protruding from the inner surface of the metal shell 1 within the screw portion 7 to prevent slippage of the insulator 2. And an opening marginal part at the rear end of the metal shell 1 is caulked to a rear end surface of the flange portion 2*e* directly or indirectly via other member.

In this embodiment, the stage portion 2*w* of the insulator 2 is engaged via a ring-like plate packing 63 with the convex portion 1*c* as the metal shell engaging portion on the side of the metal shell 1 to prevent slippage axially. On the other hand, a ring-like line packing 62 for engaging the peripheral marginal part of the flange-like flange portion 2*e* is disposed between the inner surface of the opening portion backward of the metal shell 1 and the outer surface of the insulator 2, and a ring-like packing 60 is disposed via a filling layer 61 made of talc or the like backward thereof. And the insulator 2 is pushed forward into the metal shell 1, and the opening edge of the metal shell 1 is caulked inwardly toward the packing 60 to form a caulk portion 1*d*, so that the metal shell 1 is secured with the insulator 2.

The screw portion 7 of the metal shell 1 has a thread reach Lth of 25 mm or larger. By the thread reach Lth is meant the length from the forward end edge position of the gas seal portion 1*g* to the forward end edge position of the metal shell 1 in the axial direction of the metal shell 1. And as a result of making a long thread reach Lth in this way, the length of the middle trunk portion 2*g* is increased, and the top end of the terminal 13 is located by getting into the middle trunk portion 2*g*. Assuming that the outer diameter of the middle trunk portion 2*g* at a position corresponding to the leading end edge of the terminal 13 is D, and the inner diameter of the through hole in the middle trunk portion 2*g* is d, the wall thickness of the middle trunk portion 2*g* is determined to satisfy the following relation:

$$0.42 \leqq (D-d)/D \leqq 0.79 \quad (1)$$

Figure 4A:
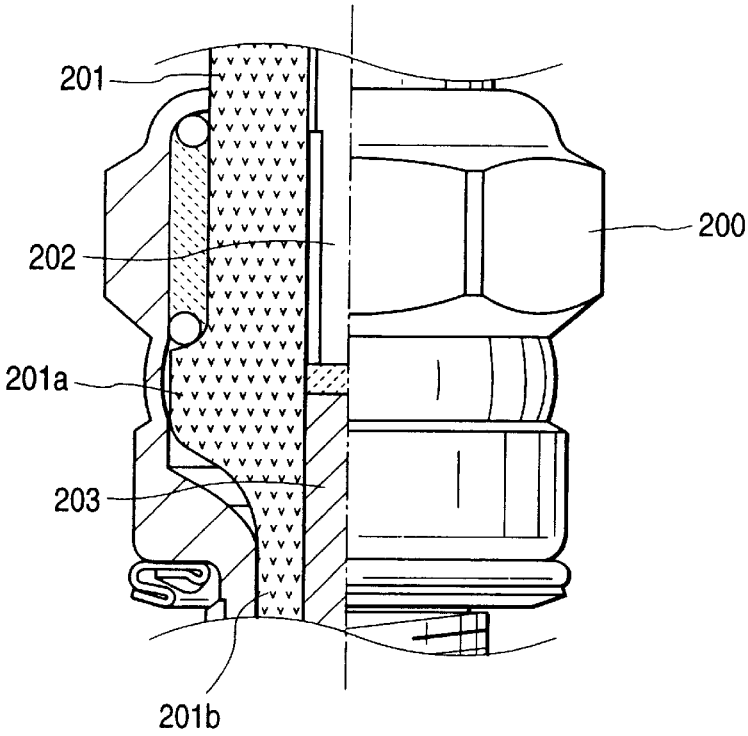
FIGS. 4A and 4B are typical views for explaining how the top end position of the metal shell changes as the screw portion has a longer reach.
Figure 4B:
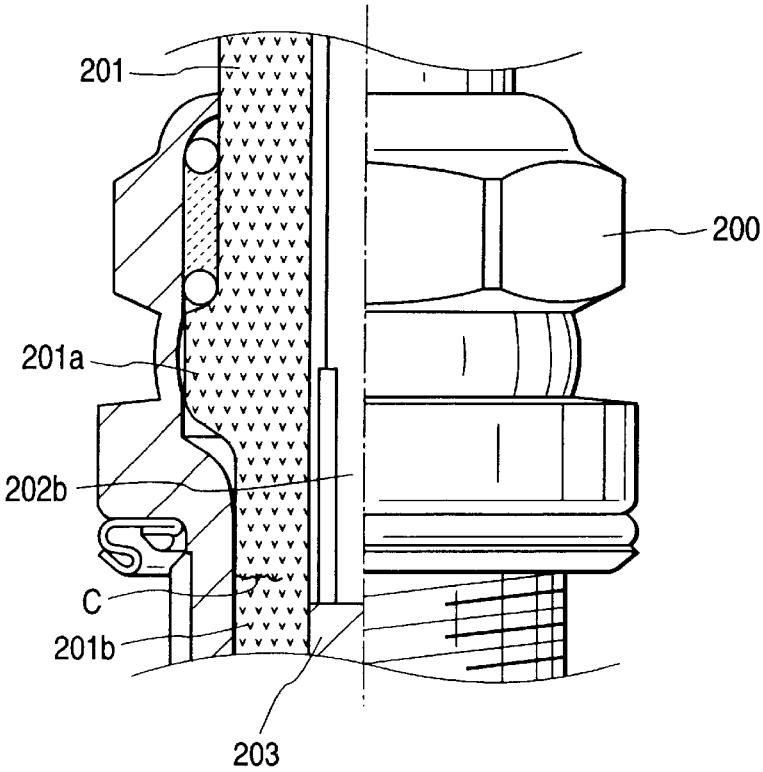

As shown in FIG. 4A, in a normal sparkplug having a thread reach of 20 mm or less, the terminal 202 is adjusted in length so that the leading edge of the terminal 202 may be located in correspondence to the flange portion 201*b*. However, if the thread reach Lth is 25 mm or greater as in the spark plug of this embodiment as shown in FIG. 1, it is required to lengthen the middle trunk portion 2*g* of the insulator as described above. On the other hand, since the length of the resistor 15 located within the middle trunk portion 2*g* can not be changed freely due to the restriction of the set value of resistor, the length of the top end portion for the terminal 13 must be extended to cope with this, thereby securing communication with the resistor 15.

There is an alternate way of shortening the length of the insulator extending backward from the metal shell to preventing the increase in length of terminal, as disclosed in Japanese Patent Unexamined Publication No. Hei. 11-273827 (JP-A-11-273827). However, with this alternate way, the flashover is more likely to occur, the length of the insulator is less extended, whereby there is the need of taking some preventive measure against the flashover. Thus, in the present invention, a structure is determined as requisite in which the leading end edge of the terminal 13 is extended to an intruding portion to get into the middle trunk portion 2*g*. With this structure, the length of the insulator 2 extending backward of the metal shell 1 is kept to be considerably large in the sparkplug having a thread reach Lth of 25 mm or greater, thereby enhancing the flashover resistance. However, in this case, apart from this respect, since the leading end edge of the terminal 13 that serves as a support against fracture is located within the middle trunk portion 2*g* that is thinner than the flange portion 2*e*, the strength problem may be liable to occur. Thus, the wall thickness of the middle trunk portion 2*g* at a position corresponding to the top end edge of the terminal 13 (hereinafter simply referred to as a "wall thickness of middle trunk portion", unless specifically noted) is determined such that the value of (D−d)/D is 0.42 or larger, whereby even if the bending of the insulator 2 or impact or torsion on the insulator 2 may be caused with some strength, when the spark plug is attached, and the malfunction such as fracture on the insulator 2, particularly, the middle trunk portion 2*g* may be less likely to occur. The value of (D−d)/D is set to be 0.78 or less. This is because the thickness of the center electrode 3 is maintained so that the heat release of the spark plug may be sufficient (more preferably, the value of (D−d)/D is set in the range from 0.43 to 0.60).

If the internal diameter d of the through hole 6 in the insulator 2 is secured fully, the outer diameter D of the middle trunk portion 2*g* must be increased. However, the nominal sizes for the screw portion 7 for receiving the middle trunk portion 2*g* are generally fixed at some values according to the standards. For example, for a number of spark plugs, the nominal sizes for the screw portion are set to any one of M10, M12 and M14. Regarding the outer diameter D of the middle trunk portion 2*g* received therein, there is actually little degree of freedom in design. Accordingly, the wall thickness of the middle trunk portion 2*g* in the insulator 2 can be adjusted mainly by regulating the inner diameter d of the through hole. In this specification, the nominal sizes for the screw portion are defined in the ISO8470 (M14) , ISO 2705 (M12) and ISO 2704 (M10) (or JIS-B8031 for other sizes), in which there are naturally permissible variations within the range of tolerance as defined in the standards.

For example, assuming that the nominal size for the screw portion 7 is represented by M in mm, and the inner diameter of the metal shell 1 in the screw portion 7 is denoted by DM, the wall thickness of the screw portion 7 is preferably set to satisfy the following relation:

$$0.2 \leqq (M-DM)/M \leqq 0.5 \quad (2)$$

When (M−DM)/M is less than 0.2, the wall thickness of the screw portion 7 is so small that the screw portion 7 has less torsional rigidity when subjected to clamping torque, exerting great torque on the middle trunk portion 2*g* of the insulator 2, and the malfunction such as fracture is more likely to occur. On the other hand, if (M−DM)/M is beyond 0.5, the outer diameter D of the middle trunk portion 2*g* is so small that it is difficult to maintain the value of (D−d)/D at a value of 0.42 or greater. The value of (M−DM)/M is preferably in the range from 0.3 to 0.4.

For example, in the case where the nominal size for the screw portion 7 is M10, the outer diameter D of the middle trunk portion 2*g* is preferably from 6.0 to 7.0 mm, the inner diameter of the through hole 6 is preferably from 2.5 to 3.5 mm, and the difference D−d between both values is preferably from 2.5 to 4.5 mm. Also, in the case where the nominal size for the screw portion 7 is M12, the outer diameter D of the middle trunk portion 2*g* is preferably from 7.0 to 8.0 mm, the inner diameter of the through hole 6 is preferably from 3.0 to 4.0 mm, and the difference D−d between both values is preferably from 3.0 to 5.0 mm. Further, in the case where the nominal size for the screw portion 7 is M14, the outer diameter D of the middle trunk portion 2*g* is preferably from 9.0 to 10.0 mm, the inner diameter of the through hole 6 is preferably from 3.0 to 4.5 mm, and the difference D−d between both values is preferably from 4.5 to 7.0 mm.

As the endurance strength of the middle trunk portion 2*g* in the insulator 2 when subjected to bending or impact, the length L1 of the middle trunk portion 2*g* is important, because thinner and slender member is more likely to break as can be esteemed. That is, in order to maintain the mechanical strength of the insulator 2 in excellent condition, the length L1 of the middle trunk portion 2*g* is optimized in accordance with the value of d, in addition to adjustment of the wall thickness with the inner diameter d of the through hole 6, and the balance between the length and the wall thickness of the middle trunk portion is maintained to retain the strength, as an important idea. More specifically, the length L1 of the middle trunk portion 2*g* desirably satisfies the following expression:

$$2.7 \leqq L1/(D-d) \leqq 10 \quad (3)$$

If the value of L1/(D−d) is beyond 10, the length L1 of the middle trunk portion 2*g* is too large with respect to the wall thickness (which can be represented as (D−d)/2 on average) of the middle trunk portion 2*g,* so that the breakage is more likely to occur owing to impact exerted on the middle trunk portion 2*g*. On the other hand, if the value of L1/(D−d) is less than 2.7, the length L1 is too small to the wall thickness, so that the screw portion 7 can not have longer reach. The value of L1/(D−d) is more desirably set in the range from 3.0 to 7.8.

On one hand, assuming that the length of an insulator rear portion leading from the rear edge of the insulator 2 to the front edge of the flange portion in a direction of the axial line O of the insulator 2 is Lj, it is desirable to satisfy the following expression:

$$0.38 \leqq L1/Lj \leqq 0.72 \quad (4)$$

The fact that the value of L1/Lj is beyond 0.72 means that the length L1 of the middle trunk portion is excessive large, or the length Lj of the insulator rear portion is excessive small. In the former case, the malfunction such as breakage of the middle trunk portion 2*g* is more likely to occur, while in the latter case, the flashover resistance of the spark plug 100 is damaged. On the other hand, the fact that the value of L1/Lj is less than 0.38 means that the length L1 of the middle trunk portion is excessive small, or the length Lj of the insulator rear portion is excessive large. In the former case, there is inconvenience that the longer reach of the screw portion 7 can not be effected, while in the latter case, the overall size of the spark plug is too large, resulting in the problem with the space for attaching the spark plug 100 within the engine room. The value of L1/Lj is more desirably set in the range from 0.4 to 0.7. In view of enhancing the mechanical strength of the middle trunk portion 2*g,* it is desired that the relation of the expression (4) stands simultaneously with the relation of the expression (3).

The present invention can exhibit the above effect so far as the top end portion of the terminal 13 for the spark plug basically penetrates slightly the middle trunk portion 2*g*. However, assuming that the penetration length is Lm and the length of the middle trunk portion is L1, a spark plug satisfying the relation $$0.1 \leqq Lm/L1$$

is likely to exert a bending moment against fracture on the top edge of the terminal 13 greatly to some extent, whereby there is a significant repercussion effect on the breakage prevention when the present invention is applied. Among others, in a spark plug having the top edge of the terminal 13 projecting out of the front edge of the connecting portion 2*f,* there is a more remarkable effect. Also, the value of Lm/L1 of less than 0.1 means that the penetration length Lm of the top end portion of the terminal 13 is less than 10% of the length L1 of the middle trunk portion, notwithstanding that the screw portion 7 has a long reach of 25 mm or more. Hence, the electrically conductive binder layer 14 such as the glass seal layers 16, 17 or the resistor 15 placed within the middle trunk portion is too long, depending on the dimensions of the parts of the spark plug, the production or the adjustment of electrical characteristics may possibly become difficult.

On the other hand, in the case where the value of Lm/L1 does not satisfy a range of the following relation $$0.1 \leqq Lm/L1 \leqq 0.2 \quad (5)$$

, there are some cases causing the following inconveniences.

(1) In the case where the electrically conductive binder layer 14 placed within the middle trunk portion 2*g* contains the resistor 15, the length of the resistor 15 becomes too short, the adjustment of resistance may become difficult.

(2) In order to increase the penetration length Lm of the top end portion of the terminal 13, it is required to reduce the length of the rear end portion of the insulator or increase the length of the middle trunk portion 2*g*. In the former case, if the degree of reduction is excessive, the flashover resistance of the spark plug 100 is damaged, while in the latter case, the middle trunk portion 2*g* becomes too slender, causing the inconvenience such as breakage, when subjected to the bending or impact.

Figure 2:
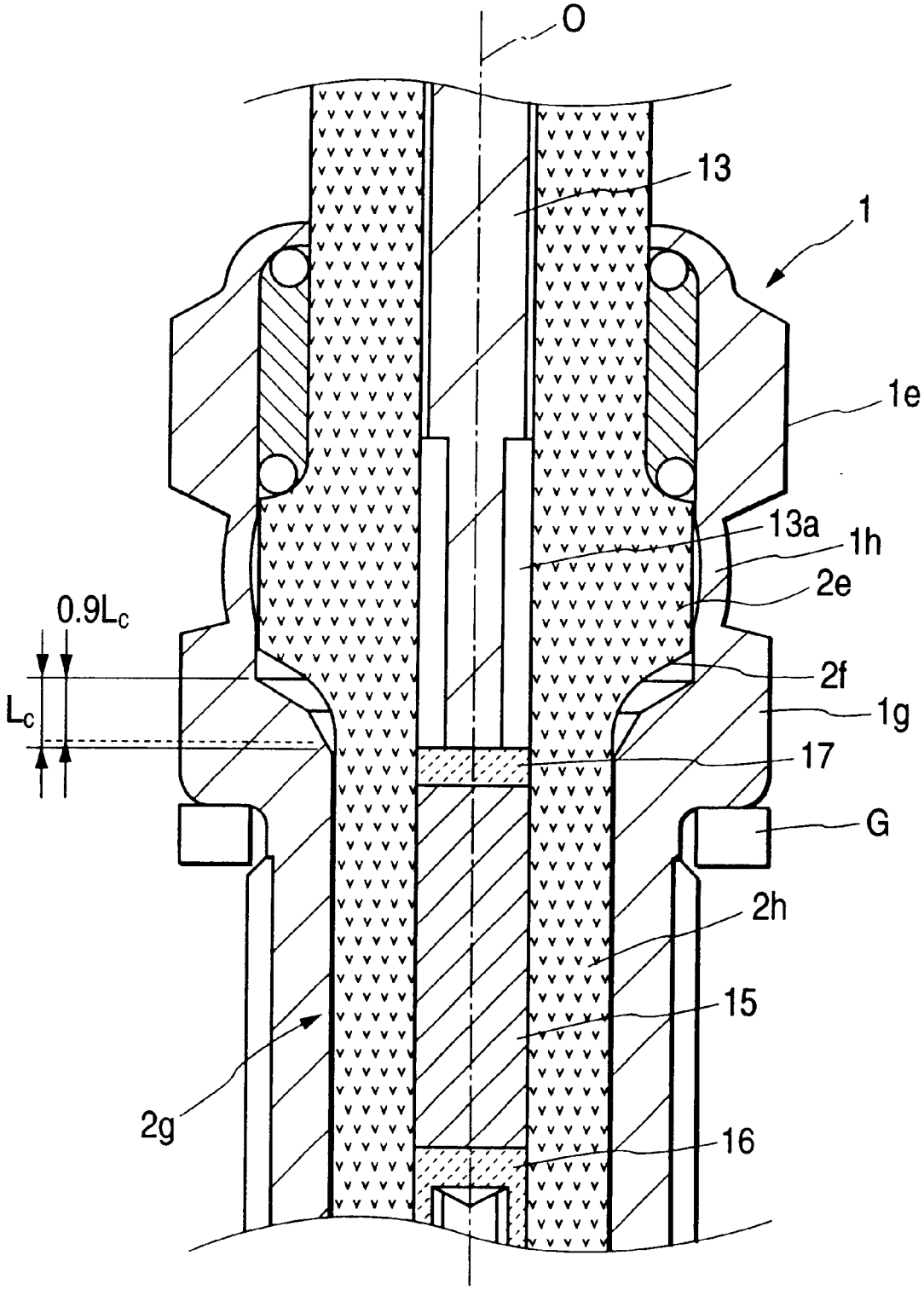
FIG. 2 is an enlarged cross-sectional view of the essence of FIG. 1.

In the case where it is designed that the top edge of the terminal 13 is located 0.9Lc or greater apart from a top end of the connecting portion 2*f* closer to the flange portion in a direction of the axial line O, and among others, the top edge of the terminal 13 is located by getting into the middle trunk main portion 2*h,* supposing that the length of the connecting portion 2*f* in the direction of the axial line O is Lc, as shown in FIG. 2, a particular precaution against breakage of the insulator must be taken, because the connecting portion 2*f* gives rise to little increase in the wall thickness of the terminal at the top edge position. Thus, the wall thickness of the terminal 13 at the top edge position is adjusted such that the value of (D−d)/D satisfies the previous range (1), whereby the effects of the invention can be more remarkably exhibited.

More specifically, the dimensions of the parts are adjusted in the following range (the values of the embodiment as shown in FIG. 1 are indicated within the parentheses).

Nominal size of screw portion 7: M10, M12, M14 (M12)

Internal diameter DM of metal shell 1 in the screw portion 7: 6 mm to 10 mm (7.5 mm)

(M−DM)/M: 0.3 to 0.5 (0.38)

Thread reach Lth of screw portion 7: 25 mm to 35 mm (26.5 mm)

Total length Ltot of insulator 2: 50 mm to 75 mm (68 mm)

Length L1 of middle trunk portion 2*g:* 12 mm to 25 mm (20 mm)

Backward projecting length Lp: 20 mm to 35 mm (25 mm)

Length L2 of top end portion 2*i:* 2 mm to 25 mm (12 mm)

Outer diameter de of flange portion 2*e:* 12 mm to 16 mm (13 mm)

Outer diameter D of middle trunk portion 2*g:* 6 mm to 10 mm (7.3 mm)

Inner diameter d of through hole 6: 2.5 mm to 4.5 mm (3.9 mm)

Penetration length Lm of the top end portion of terminal 13 into the middle trunk portion 2*g:* 20 mm or less (2.5 mm)

(D−d)/D: 0.42 to 0.78 (0.47)

L1/(D−d): 2.7 to 10 (5.9)

L1/Lj: 0.4 to 0.72 (0.56)

Lm/L1: 0.1 to 0.5 (0.13)

Figure 3A:
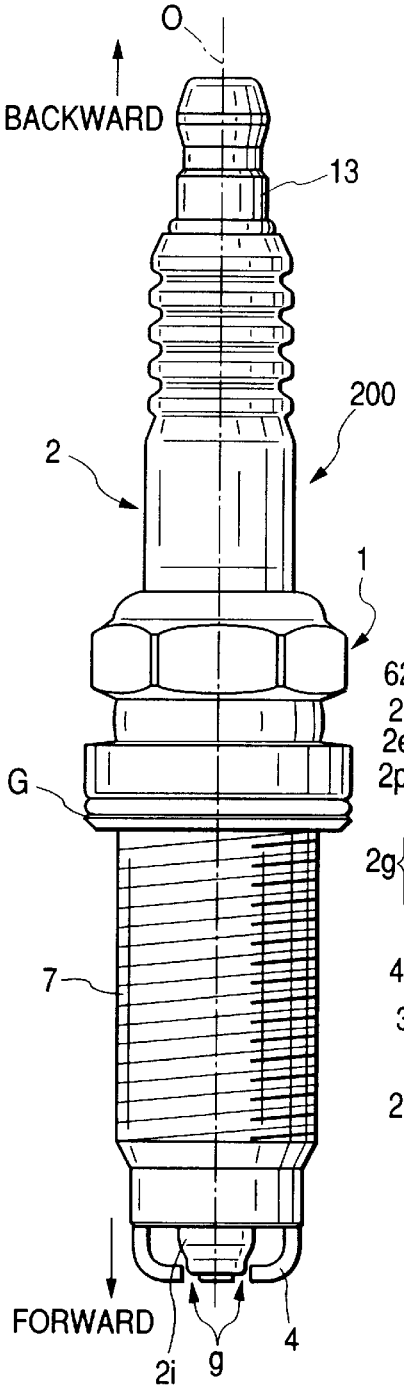
FIGS. 3A to 3C are front views and the longitudinal cross-sectional views of a spark plug according to another embodiment of the invention.
Figure 3B:
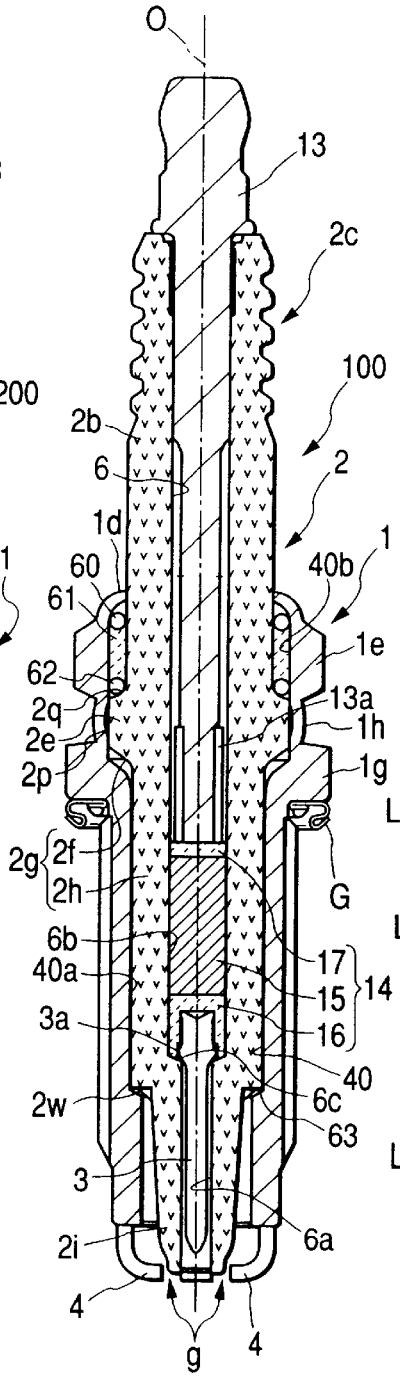
Figure 3C:
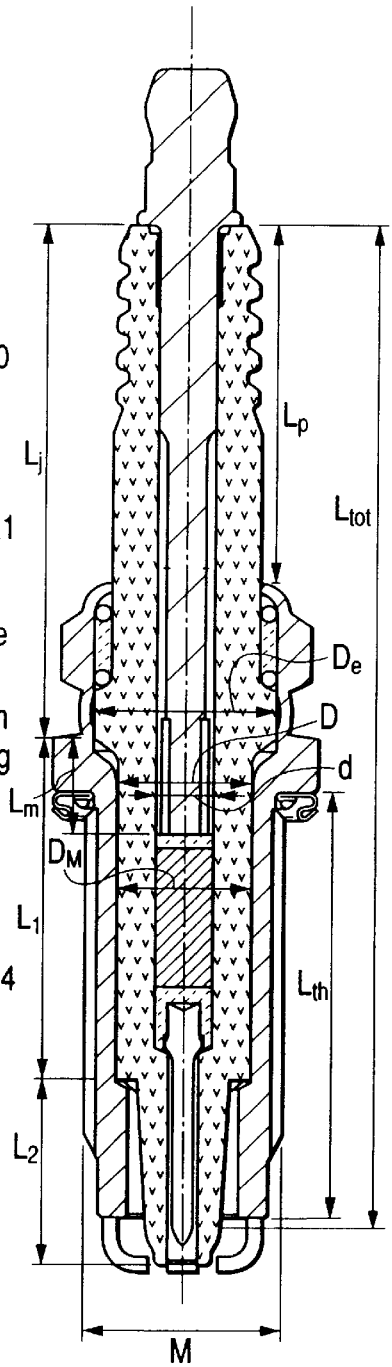

FIG. 3 illustrates another embodiment of a spark plug according to the invention. The spark plug 200 is configured as a so-called semi-surface discharge spark plug, having a plurality of ground electrodes 4, each of which carries the top end portion of the insulator 2 across which the lateral surface of the center electrode 3 and the top end side are opposed to each other. In this embodiment, two ground electrodes 4 are provided one on either side of the center electrode 3 (i.e., a sort of multi-electrode spark plug). Each end surface is bent so as to be opposed in parallel to the lateral face of the center electrode 3 via the insulator 2, while the other end surface is secured or integrated by welding with the metal shell 1. The insulator 2 is disposed in a positional relation where the top end portion of the insulator 2 enters between the lateral surface of the center electrode 3 and the end surface of the ground electrode 4. Other constitutional parts are conceptually the same as those of the spark plug 100 of FIG. 1, except for the size, wherein the corresponding parts are designated by the like numerals and the detailed description will be omitted. In this spark plug 200, if a high voltage for discharging is applied so that the center electrode 3 is negative and the ground electrode 4 is positive, the spark propagates in the course along the surface of the top end portion of the insulator 2 between the end surface of the ground electrode 4 and the center electrode 3, the pollution proof is improved.

The parts of the spark plug as shown in FIG. 3 have the following dimensions.

Nominal size of screw portion: M14

Internal diameter DM of metal shell 1 in the screw portion 7: 9.5 mm (M−DM)/M: 0.32

Thread reach Lth of screw portion 7: 29.5 mm

Total length Ltot of insulator 2: 72.5 mm

Length L1 of middle trunk portion 2*g:* 22.5 mm

Backward projecting length Lp: 25 mm

Length L2 of top end portion 2*i:* 14 mm

Outer diameter de of flange portion 2*e:* 13 mm

Outer diameter D of middle trunk portion 2*g:* 9.2 mm

Inner diameter d of through hole 6: 3.9 mm

Penetration length Lm of the top end portion of terminal 13 into the middle trunk portion 2*g:* 5.5 mm (D−d)/D: 0.58

L1/(D−d): 4.2

L1/Lj: 0.63

Lm/L1: 0.24

Table 1 shows the set-up examples of combining the values D and d that satisfy the condition (1). Also, Table 2 shows the set-up examples of combining the values L1 and (D−d) that satisfy the condition (3). Further, Table 3 shows the set-up examples of combining the values L1 and Lj that satisfy the condition (4).

TABLE 1

| | | d (unit: mm) | | | | | | | | | | | | | | | | |
|---|---|---|---|---|---|---|---|---|---|---|---|---|---|---|---|---|---|---|
| | | 6.0 | 6.2 | 6.4 | 6.9 | 7.0 | 7.1 | 7.2 | 7.3 | 7.4 | 8.8 | 8.9 | 9.0 | 9.1 | 9.2 | 9.3 | 9.4 | 9.5 |
| D (unit: mm) | 1.8 | 0.700 | 0.710 | 0.719 | 0.739 | 0.743 | 0.746 | 0.750 | 0.753 | 0.757 | — | — | — | — | — | — | — | — |
| | 2.0 | 0.667 | 0.677 | 0.688 | 0.710 | 0.714 | 0.718 | 0.722 | 0.726 | 0.730 | 0.773 | 0.775 | 0.778 | 0.780 | 0.783 | 0.785 | 0.787 | 0.789 |
| | 2.2 | 0.633 | 0.645 | 0.656 | 0.681 | 0.686 | 0.690 | 0.694 | 0.699 | 0.703 | 0.750 | 0.753 | 0.756 | 0.758 | 0.761 | 0.763 | 0.766 | 0.768 |
| | 2.4 | 0.600 | 0.613 | 0.625 | 0.652 | 0.657 | 0.662 | 0.667 | 0.671 | 0.676 | 0.727 | 0.730 | 0.733 | 0.736 | 0.739 | 0.742 | 0.745 | 0.747 |
| | 2.6 | 0.567 | 0.581 | 0.594 | 0.623 | 0.629 | 0.634 | 0.639 | 0.644 | 0.649 | 0.705 | 0.708 | 0.711 | 0.714 | 0.717 | 0.720 | 0.723 | 0.726 |
| | 2.8 | 0.533 | 0.548 | 0.563 | 0.594 | 0.600 | 0.606 | 0.611 | 0.616 | 0.622 | 0.682 | 0.685 | 0.689 | 0.692 | 0.696 | 0.699 | 0.702 | 0.705 |
| | 3.0 | 0.500 | 0.516 | 0.531 | 0.565 | 0.571 | 0.577 | 0.583 | 0.589 | 0.595 | 0.659 | 0.663 | 0.667 | 0.670 | 0.674 | 0.677 | 0.681 | 0.684 |
| | 3.2 | 0.467 | 0.484 | 0.500 | 0.536 | 0.543 | 0.549 | 0.556 | 0.562 | 0.568 | 0.636 | 0.640 | 0.644 | 0.648 | 0.652 | 0.656 | 0.660 | 0.663 |
| | 3.4 | 0.433 | 0.452 | 0.469 | 0.507 | 0.514 | 0.521 | 0.528 | 0.534 | 0.541 | 0.614 | 0.618 | 0.622 | 0.626 | 0.630 | 0.634 | 0.638 | 0.642 |
| | 3.6 | | | 0.438 | 0.478 | 0.486 | 0.493 | 0.500 | 0.507 | 0.514 | 0.591 | 0.596 | 0.600 | 0.604 | 0.609 | 0.613 | 0.617 | 0.621 |
| | 3.8 | | | | 0.449 | 0.457 | 0.465 | 0.472 | 0.479 | 0.486 | 0.568 | 0.573 | 0.578 | 0.582 | 0.587 | 0.591 | 0.596 | 0.600 |
| | 4.0 | | | | 0.420 | 0.429 | 0.437 | 0.444 | 0.452 | 0.459 | 0.545 | 0.551 | 0.556 | 0.560 | 0.565 | 0.570 | 0.574 | 0.579 |
| | 4.2 | | | | | | | | 0.425 | 0.432 | 0.523 | 0.528 | 0.533 | 0.538 | 0.543 | 0.548 | 0.553 | 0.558 |
| | 4.4 | | | | | | | | | | 0.500 | 0.506 | 0.511 | 0.516 | 0.522 | 0.527 | 0.532 | 0.537 |

TABLE 2

| | | D-d (unit: mm) | | | | | | | | | | | |
|---|---|---|---|---|---|---|---|---|---|---|---|---|---|
| | | 2.8 | 2.9 | 3.0 | 3.1 | 3.2 | 3.3 | 3.4 | 3.5 | 3.6 | 3.7 | 4.4 | 4.6 |
| L1 | 9 | 3.21 | 3.10 | 3.00 | 2.90 | 2.81 | 2.73 | — | — | — | — | — | — |
| (unit: | 10 | 3.57 | 3.45 | 3.33 | 3.23 | 3.13 | 3.03 | 2.94 | 2.86 | 2.78 | 2.70 | — | — |
| mm) | 11 | 3.93 | 3.79 | 3.67 | 3.55 | 3.44 | 3.33 | 3.24 | 3.14 | 3.06 | 2.97 | — | — |
| | 12 | 4.29 | 4.14 | 4.00 | 3.87 | 3.75 | 3.64 | 3.53 | 3.43 | 3.33 | 3.24 | 2.73 | — |
| | 13 | 4.64 | 4.48 | 4.33 | 4.19 | 4.06 | 3.94 | 3.82 | 3.71 | 3.61 | 3.51 | 2.95 | 2.83 |
| | 14 | 5.00 | 4.83 | 4.67 | 4.52 | 4.38 | 4.24 | 4.12 | 4.00 | 3.89 | 3.78 | 3.18 | 3.04 |
| | 15 | 5.36 | 5.17 | 5.00 | 4.84 | 4.69 | 4.55 | 4.41 | 4.29 | 4.17 | 4.05 | 3.41 | 3.26 |
| | 16 | 5.71 | 5.52 | 5.33 | 5.16 | 5.00 | 4.85 | 4.71 | 4.57 | 4.44 | 4.32 | 3.64 | 3.48 |
| | 17 | 6.07 | 5.86 | 5.67 | 5.48 | 5.31 | 5.15 | 5.00 | 4.86 | 4.72 | 4.59 | 3.86 | 3.70 |
| | 18 | 6.43 | 6.21 | 6.00 | 5.81 | 5.63 | 5.45 | 5.29 | 5.14 | 5.00 | 4.86 | 4.09 | 3.91 |
| | 19 | 6.79 | 6.55 | 6.33 | 6.13 | 5.94 | 5.76 | 5.59 | 5.43 | 5.28 | 5.14 | 4.32 | 4.13 |
| | 20 | 7.14 | 6.90 | 6.67 | 6.45 | 6.25 | 6.06 | 5.88 | 5.71 | 5.56 | 5.41 | 4.55 | 4.35 |
| | 21 | 7.50 | 7.24 | 7.00 | 6.77 | 6.56 | 6.36 | 6.18 | 6.00 | 5.83 | 5.68 | 4.77 | 4.57 |
| | 22 | 7.86 | 7.59 | 7.33 | 7.10 | 6.88 | 6.67 | 6.47 | 6.29 | 6.11 | 5.95 | 5.00 | 4.78 |
| | 23 | 8.21 | 7.93 | 7.67 | 7.42 | 7.19 | 6.97 | 6.76 | 6.57 | 6.39 | 6.22 | 5.23 | 5.00 |
| | 24 | 8.57 | 8.28 | 8.00 | 7.74 | 7.50 | 7.27 | 7.06 | 6.86 | 6.67 | 6.49 | 5.45 | 5.22 |
| | 25 | 8.93 | 8.62 | 8.33 | 8.06 | 7.81 | 7.58 | 7.35 | 7.14 | 6.94 | 6.76 | 5.68 | 5.43 |
| | 26 | 9.29 | 8.97 | 8.67 | 8.39 | 8.13 | 7.88 | 7.65 | 7.43 | 7.22 | 7.03 | 5.91 | 5.65 |
| | 27 | 9.64 | 9.31 | 9.00 | 8.71 | 8.44 | 8.18 | 7.94 | 7.71 | 7.50 | 7.30 | 6.14 | 5.87 |
| | 28 | 10.00 | 9.66 | 9.33 | 9.03 | 8.75 | 8.48 | 8.24 | 8.00 | 7.78 | 7.57 | 6.36 | 6.09 |
| | 29 | — | 10.00 | 9.67 | 9.35 | 9.06 | 8.79 | 8.53 | 8.29 | 8.06 | 7.84 | 6.59 | 6.30 |
| | 30 | — | — | 10.00 | 9.68 | 9.38 | 9.09 | 8.82 | 8.57 | 8.33 | 8.11 | 6.82 | 6.52 |
| | 31 | — | — | — | 10.00 | 9.69 | 9.39 | 9.12 | 8.86 | 8.61 | 8.38 | 7.05 | 6.74 |
| | 32 | — | — | — | — | 10.00 | 9.70 | 9.41 | 9.14 | 8.89 | 8.65 | 7.27 | 6.96 |
| | | 4.7 | 4.8 | 4.9 | 5.0 | 5.1 | 5.2 | 5.3 | 5.4 | 5.5 | 5.6 | 5.8 | 6 |
| L1 | 9 | — | — | — | — | — | — | — | — | — | — | — | — |
| (unit: | 10 | — | — | — | — | — | — | — | — | — | — | — | — |
| mm) | 11 | — | 3.79 | 3.67 | 3.55 | 3.44 | 3.33 | 3.24 | 3.14 | 3.06 | 2.97 | — | — |
| | 12 | — | — | — | — | — | — | — | — | — | — | — | — |
| | 13 | 2.77 | 2.71 | — | — | — | — | — | — | — | — | — | — |
| | 14 | 2.98 | 2.92 | 2.86 | 2.80 | 2.75 | — | — | — | — | — | — | — |
| | 15 | 3.19 | 3.13 | 3.06 | 3.00 | 2.94 | 2.88 | 2.83 | 2.78 | 2.73 | — | — | — |
| | 16 | 3.40 | 3.33 | 3.27 | 3.20 | 3.14 | 3.08 | 3.02 | 2.96 | 2.91 | 2.86 | 2.76 | — |
| | 17 | 3.62 | 3.54 | 3.47 | 3.40 | 3.33 | 3.27 | 3.21 | 3.15 | 3.09 | 3.04 | 2.93 | 2.83 |
| | 18 | 3.83 | 3.75 | 3.67 | 3.60 | 3.53 | 3.46 | 3.40 | 3.33 | 3.27 | 3.21 | 3.10 | 3.00 |
| | 19 | 4.04 | 3.96 | 3.88 | 3.80 | 3.73 | 3.65 | 3.58 | 3.52 | 3.45 | 3.39 | 3.28 | 3.17 |
| | 20 | 4.26 | 4.17 | 4.08 | 4.00 | 3.92 | 3.85 | 3.77 | 3.70 | 3.64 | 3.57 | 3.45 | 3.33 |
| | 21 | 4.47 | 4.38 | 4.29 | 4.20 | 4.12 | 4.04 | 3.96 | 3.89 | 3.82 | 3.75 | 3.62 | 3.50 |
| | 22 | 4.68 | 4.58 | 4.49 | 4.40 | 4.31 | 4.23 | 4.15 | 4.07 | 4.00 | 3.93 | 3.79 | 3.67 |
| | 23 | 4.89 | 4.79 | 4.69 | 4.60 | 4.51 | 4.42 | 4.34 | 4.26 | 4.18 | 4.11 | 3.97 | 3.83 |
| | 24 | 5.11 | 5.00 | 4.90 | 4.80 | 4.71 | 4.62 | 4.53 | 4.44 | 4.36 | 4.29 | 4.14 | 4.00 |
| | 25 | 5.32 | 5.21 | 5.10 | 5.00 | 4.90 | 4.81 | 4.72 | 4.63 | 4.55 | 4.46 | 4.31 | 4.17 |
| | 26 | 5.53 | 5.42 | 5.31 | 5.20 | 5.10 | 5.00 | 4.91 | 4.81 | 4.73 | 4.64 | 4.48 | 4.33 |
| | 27 | 5.74 | 5.63 | 5.51 | 5.40 | 5.29 | 5.19 | 5.09 | 5.00 | 4.91 | 4.82 | 4.66 | 4.50 |
| | 28 | 5.96 | 5.83 | 5.71 | 5.60 | 5.49 | 5.38 | 5.28 | 5.19 | 5.09 | 5.00 | 4.83 | 4.67 |
| | 29 | 6.17 | 6.04 | 5.92 | 5.80 | 5.69 | 5.58 | 5.47 | 5.37 | 5.27 | 5.18 | 5.00 | 4.83 |
| | 30 | 6.38 | 6.25 | 6.12 | 6.00 | 5.88 | 5.77 | 5.66 | 5.56 | 5.45 | 5.36 | 5.17 | 5.00 |
| | 31 | 6.60 | 6.46 | 6.33 | 6.20 | 6.08 | 5.96 | 5.85 | 5.74 | 5.64 | 5.54 | 5.34 | 5.17 |
| | 32 | 6.81 | 6.67 | 6.53 | 6.40 | 6.27 | 6.15 | 6.04 | 5.93 | 5.82 | 5.71 | 5.52 | 5.33 |

TABLE 3

| | | Lj (unit: mm) | | | | | | | | | | | | | |
|---|---|---|---|---|---|---|---|---|---|---|---|---|---|---|---|
| | | 30 | 32 | 34 | 36 | 38 | 40 | 42 | 44 | 46 | 48 | 50 | 52 | 54 | 56 |
| L1 | 9 | — | — | — | — | — | — | — | — | — | — | — | — | — | — |
| (unit: | 10 | — | — | — | — | — | — | — | — | — | — | — | — | — | — |
| mm) | 11 | — | — | — | — | — | — | — | — | — | — | — | — | — | — |
| | 12 | 0.400 | — | — | — | — | — | — | — | — | — | — | — | — | — |

TABLE 3-continued

| | Lj (unit: mm) | | | | | | | | | | | | | |
|---|---|---|---|---|---|---|---|---|---|---|---|---|---|---|
| | 30 | 32 | 34 | 36 | 38 | 40 | 42 | 44 | 46 | 48 | 50 | 52 | 54 | 56 |
| 13 | 0.433 | 0.406 | 0.382 | — | — | — | — | — | — | — | — | — | — | — |
| 14 | 0.467 | 0.438 | 0.412 | 0.389 | — | — | — | — | — | — | — | — | — | — |
| 15 | 0.500 | 0.469 | 0.441 | 0.417 | 0.395 | — | — | — | — | — | — | — | — | — |
| 16 | 0.533 | 0.500 | 0.471 | 0.444 | 0.421 | 0.400 | 0.381 | — | — | — | — | — | — | — |
| 17 | 0.567 | 0.531 | 0.500 | 0.472 | 0.447 | 0.425 | 0.405 | 0.386 | — | — | — | — | — | — |
| 18 | 0.600 | 0.563 | 0.529 | 0.500 | 0.474 | 0.450 | 0.429 | 0.409 | 0.391 | — | — | — | — | — |
| 19 | 0.633 | 0.594 | 0.559 | 0.528 | 0.500 | 0.475 | 0.452 | 0.432 | 0.413 | 0.396 | 0.380 | — | — | — |
| 20 | 0.667 | 0.625 | 0.588 | 0.556 | 0.526 | 0.500 | 0.476 | 0.455 | 0.435 | 0.417 | 0.400 | 0.385 | — | — |
| 21 | 0.700 | 0.656 | 0.618 | 0.583 | 0.553 | 0.525 | 0.500 | 0.477 | 0.457 | 0.438 | 0.420 | 0.404 | 0.389 | — |
| 22 | — | 0.688 | 0.647 | 0.611 | 0.579 | 0.550 | 0.524 | 0.500 | 0.478 | 0.458 | 0.440 | 0.423 | 0.407 | 0.393 |
| 23 | — | 0.719 | 0.676 | 0.639 | 0.605 | 0.575 | 0.548 | 0.523 | 0.500 | 0.479 | 0.460 | 0.442 | 0.426 | 0.411 |
| 24 | — | — | 0.706 | 0.667 | 0.632 | 0.600 | 0.571 | 0.545 | 0.522 | 0.500 | 0.480 | 0.462 | 0.444 | 0.429 |
| 25 | — | — | — | 0.694 | 0.658 | 0.625 | 0.595 | 0.568 | 0.543 | 0.521 | 0.500 | 0.481 | 0.463 | 0.446 |
| 26 | — | — | — | — | 0.684 | 0.650 | 0.619 | 0.591 | 0.565 | 0.542 | 0.520 | 0.500 | 0.481 | 0.464 |
| 27 | — | — | — | — | 0.711 | 0.675 | 0.643 | 0.614 | 0.587 | 0.563 | 0.540 | 0.519 | 0.500 | 0.482 |
| 28 | — | — | — | — | — | 0.700 | 0.667 | 0.636 | 0.609 | 0.583 | 0.560 | 0.538 | 0.519 | 0.500 |
| 29 | — | — | — | — | — | — | 0.690 | 0.659 | 0.630 | 0.604 | 0.580 | 0.558 | 0.537 | 0.518 |
| 30 | — | — | — | — | — | — | 0.714 | 0.682 | 0.652 | 0.625 | 0.600 | 0.577 | 0.556 | 0.536 |
| 31 | — | — | — | — | — | — | — | 0.705 | 0.674 | 0.646 | 0.620 | 0.596 | 0.574 | 0.554 |
| 32 | — | — | — | — | — | — | — | — | 0.696 | 0.667 | 0.640 | 0.615 | 0.593 | 0.571 |

To make sure the effects of the present invention, the following experiments have been conducted.

Figure 5:
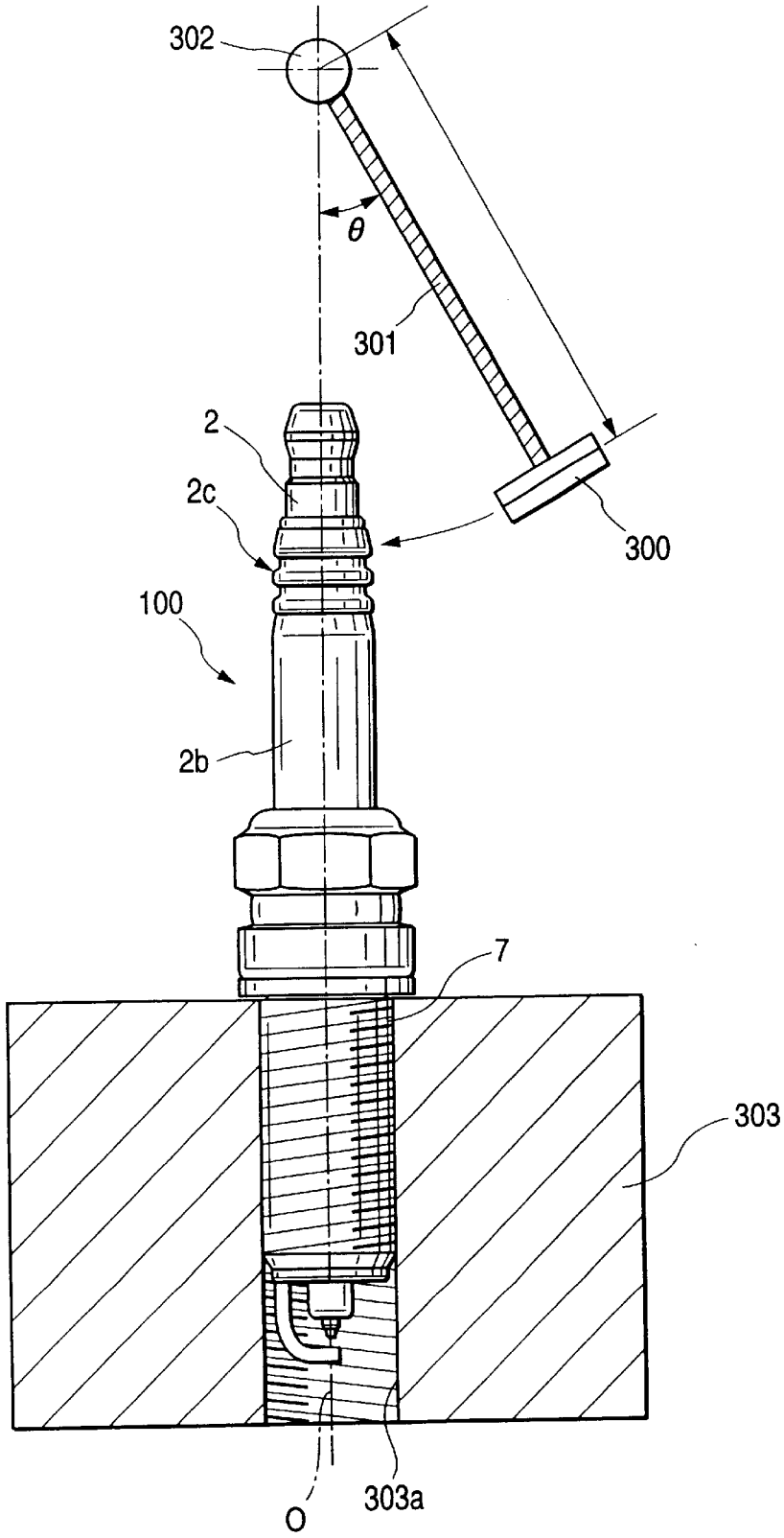
FIG. 5 is an explanatory view showing schematically an impact testing device.

In the spark plug as shown in FIG. 1, several specimens were produced with the dimensions of the parts coordinated as shown in Table 4. Every specimen had a thread reach of 26.5 mm or greater, with the top end portion of the terminal 13 penetrating into the middle trunk portion 2*g*. And the following impact tests were made for each specimen. That is, the screw portion 7 of each spark plug 100 was screwed into a tapping hole 303*a* of a specimen fixture basement 303 and fixed so that the backward main portion 2*b* of the insulator 2 extended upward, as shown in FIG. 5. Further above the backward main portion 2*b,* an arm 301 with a copper hammer 300 at the upper end was attached swingably to an axial fulcrum 302 located on the central axial line O of the insulator 2. The length of the arm 301 was 330 mm, and the weight of the hammer 300 was 1.13 kg. The position of the axial fulcrum 302 was determined so that the hammer position which was swung down to the backward main portion 2*b* of the insulator 2 might correspond to the first crest position of the corrugation 2*c*. The hammer 300 was brought up to a predetermined angle of revolution from the central axial line O of the arm 301, and swung down toward the backward main portion 2*b* to freely drop. This operation was repeatedly with increasingly greater angle, and the critical angle θ at which the fracture occurred in the insulator was obtained. The specimen with an angle of 30° or greater was determined as acceptable. The above results are shown in Table 4.

TABLE 4

| A | B | C | D | E | F | G | H | I | J | K | L | M | N |
|---|---|---|---|---|---|---|---|---|---|---|---|---|---|
| 1 | 26.5 | M14 | 1.0 | 9.2 | 3.9 | 0.58 | 18.0 | 3.4 | 12.0 | 69.0 | 39.0 | 0.46 | 48 ○ |
| 2 | 29.5 | M14 | 5.5 | 9.2 | 3.9 | 0.58 | 22.5 | 4.2 | 14.0 | 72.5 | 36.0 | 0.63 | 46 ○ |
| 3 | 26.5 | M14 | 0.5 | 9.2 | 3.9 | 0.58 | 17.5 | 3.3 | 14.0 | 67.5 | 36.0 | 0.49 | 52 ○ |
| 4 | 26.5 | M12 | 7.5 | 7.3 | 3.9 | 0.47 | 24.0 | 7.1 | 12.0 | 72.5 | 36.5 | 0.66 | 36 ○ |
| 5 | 26.5 | M12 | 2.5 | 7.3 | 3.9 | 0.47 | 20.0 | 5.9 | 12.0 | 68.0 | 36.0 | 0.56 | 40 ○ |
| 6 | 26.5 | M12 | 5.5 | 7.3 | 3.9 | 0.47 | 23.0 | 6.8 | 9.0 | 68.0 | 36.0 | 0.64 | 38 ○ |
| 7 | 26.5 | M12 | 10.0 | 7.3 | 3.9 | 0.47 | 25.5 | 7.5 | 2.5 | 73.5 | 45.5 | 0.56 | 36 ○ |
| 8 | 26.5 | M12 | 1.5 | 7.3 | 3.9 | 0.47 | 17.0 | 5.0 | 17.0 | 70.0 | 36.0 | 0.47 | 42 ○ |
| 9 | 26.5 | M12 | 1.5 | 7.3 | 3.9 | 0.47 | 19.0 | 5.6 | 15.0 | 70.0 | 36.0 | 0.53 | 40 ○ |
| 10 | 26.5 | M12 | 1.5 | 7.3 | 3.0 | 0.59 | 19.0 | 4.4 | 15.0 | 70.0 | 36.0 | 0.53 | 44 ○ |
| 11* | 26.5 | M12 | 1.5 | 7.3 | 4.3 | 0.41 | 19.0 | 6.3 | 15.0 | 70.0 | 36.0 | 0.53 | 28 X |

A: Specimen Number
B: Thread reach
C: Nominal size of screw portion
D: Penetration length into middle trunk portion Lm (mm)
E: Outer diameter of through hole D (mm)
F: Inner diameter of through hole d (mm)
G: (D-d)/D
H: Length of middle trunk portion L1 (mm)
I: L1/(D-d)
J: Length of top end portion L2 (mm)
K: Total length of insulator Ltot (mm)
L: Length of insulator rear portion Lj (mm)
M: L1/Lj
N: Impact test result
*indicates outside the scope of the invention.

The specimen satisfying the relation $0.42 \leqq (D-d)/D \leqq 0.79$ has a critical angle θ of 30° or greater. It will be found that the insulator is less likely to cause the impact fracture.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A spark plug comprising:

a center electrode disposed on an axial center in axial direction of said spark plug;

an axial insulator which covers the outside of said center electrode and secures said center electrode at a forward side thereof;

a metal shell which is shaped like a barrel that is open at both ends and disposed outside said electrode;

a ground electrode which forms a spark discharge gap with respect to said electrode, being connected to said metal shell;

a screw portion whose thread reach in 25 mm or greater, formed on an outside circumferential surface of the forward end portion of said metal shell;

a peripheral flange portion which protrudes outward at a portion of said insulator located within said metal shell half way in the axial direction;

a middle trunk portion which is adjacent to a forward side of said flange portion, wherein the middle trunk portion includes a connecting section where axial sectional size changes to have a largest diameter at the forward side of said flange portion and a middle trunk main section having a substantially uniform axial sectional size adjacent to a forward side of the connecting section;

a terminal is secured at a backward side of said insulator, wherein a bottom end edge of said terminal protrudes from the backward side of said insulator;

a portion which defines a through hole formed in the axial direction of said insulator; and an electrically conductive binder layer is disposed between said terminal and said center electrode within said through hole, wherein the forward side is defined as the side where said spark discharge gap is located in an axial direction of said insulator, a backward side is defined as the opposite side, and a top end edge of said terminal penetrates through said connecting section in said middle trunk portion of said insulator.

2. The spark plug according to claim 1, wherein the wall thickness of said middle trunk portion is determined to satisfy the relation such as:

$$0.42 \leqq (D-d)/D \leqq 0.79$$

where the outer diameter of said middle trunk portion at a position corresponding to the top end edge of said terminal is D, and the inner diameter of said through hole in said middle trunk portion is d.

3. The spark plug according to claim 1, wherein the wall thickness of said middle trunk portion is determined to satisfy the relation such as:

$$0.43 \leqq (D-d)/D \leqq 0.60$$

where the outer diameter of said middle trunk portion at a position corresponding to the top end edge of said terminal is D, and the inner diameter of said through hole in said middle trunk portion is d.

4. The spark plug according to claim 1, wherein the nominal size of said screw portion is any one of M10, M12 and M14.

5. The spark plug according to claim 2, wherein a length L1 of said middle trunk portion satisfies the relation such as $$2.7 \leqq L1/(D-d) \leqq 10$$

and satisfies the relation such as $$0.38 \leqq L1/Lj \leqq 0.72$$

where the length of a rear portion of said insulator leading from the backward side of said insulator to the forward side of said flange portion in the axial direction is Lj.

6. The spark plug according to claim 2, wherein a length L1 of said middle trunk portion satisfies the relation such as $$2.7 \leqq L1/(D-d) \leqq 10$$

and satisfies the relation such as $$0.38 \leqq L1/Lj \leqq 0.72 \text{ and}$$

$$0.1 \leqq Lm/L1 \leqq 0.2$$

where the length of a rear portion of said insulator leading from the backward side of said insulator to the forward side of said flange portion in the axial direction is Lj, and the penetration length of said terminal into said middle trunk portion is Lm.

7. A spark plug comprising:

a center electrode disposed on an axial center in axial direction of said spark plug;

an axial insulator which covers the outside of said center electrode and secures said center electrode at a forward side thereof;

a metal shell which is shaped like a barrel that is open at both ends and disposed outside said electrode;

a ground electrode which forms a spark discharge gap with respect to said electrode, being connected to said metal shell;

a screw portion whose thread reach in 25 mm or greater, formed on an outside circumferential surface of the forward end portion of said metal shell;

a peripheral flange portion which protrudes outward at a portion of said insulator located within said metal shell half way in the axial direction;

a middle trunk portion which is adjacent to a forward side of said flange portion;

a terminal secured at a backward side of said insulator, wherein a bottom end edge of said terminal protrudes from the backward side of said insulator;

a portion which defines a through hole formed in the axial direction of said insulator; and an electrically conductive binder layer disposed between said terminal and said center electrode within said through hole, wherein the forward side is defined as the side where said spark discharge gap is located in an axial direction of said insulator, a backward side is defined as the opposite side, and a front end edge of said terminal penetrates into said middle trunk portion of said insulator and wherein a length L1 of said middle trunk portion satisfies the relation such as $$0.1 \leqq Lm/L1 \leqq 0.2$$

where a penetration length of said terminal into said middle trunk portion is Lm.

8. A spark plug comprising:

a center electrode disposed on an axial center in axial direction of said spark plug;

an axial insulator which covers the outside of said center electrode and secures said center electrode at a forward side thereof;

a metal shell which is shaped like a barrel that is open at both ends and disposed outside said electrode;

a ground electrode which forms a spark discharge gap with respect to said electrode, being connected to said metal shell;

a screw portion whose thread reach in 25 mm or greater, formed on an outside circumferential surface of the forward end portion of said metal shell;

a peripheral flange portion which protrudes outward at a portion of said insulator located within said metal shell half way in the axial direction;

a middle trunk portion which is adjacent to a forward side of said flange portion;

a terminal secured at a backward side of said insulator, wherein a bottom end edge of said terminal protrudes from the backward side of said insulator;

a portion which defines a through hole formed in the axial direction of said insulator; and an electrically conductive binder layer disposed between said terminal and said center electrode within said through hole, wherein the forward side is defined as the side where said spark discharge gap is located in an axial direction of said insulator, a backward side is defined as the opposite side, and a front end edge of said terminal penetrates into said middle trunk portion of said insulator, wherein the wall thickness of said middle trunk portion is determined to satisfy the relation such as $$0.42 \leqq (D-d)/D \leqq 0.79$$

where the outer diameter of said middle trunk portion at a position corresponding to the top end edge of said terminal is D, and the inner diameter of through hole in said middle trunk portion is d, and wherein a length L1 of said middle trunk portion satisfies the relation such as $$2.7 \leqq L1/(D-d) \leqq 10$$

and satisfies the relation such as $$0.38 \leqq L1/Lj \leqq 0.72 \text{ and}$$

$$0.1 \leqq Lm/L1 \leqq 0.2$$

where the length of a rear portion of said insulator leading from the backward side of said insulator to the forward side of said flange portion in the axial direction is Lj, and the penetration length of said terminal into said middle trunk portion is Lm.

* * * * *